US005577390A

United States Patent [19]

Kaido et al.

[11] Patent Number: 5,577,390

[45] Date of Patent: Nov. 26, 1996

[54] COMPRESSOR FOR SINGLE OR MULTI-STAGE OPERATION

[75] Inventors: Peter F. Kaido, Verona; Michael J. Dormer, Fabius, both of N.Y.

[73] Assignee: Carrier Corporation, Syracuse, N.Y.

[21] Appl. No.: 338,076

[22] Filed: Nov. 14, 1994

[51] Int. Cl.[6] ..... F25B 41/04; F04C 23/00

[52] U.S. Cl. ..... 62/228.5; 62/196.2; 62/510; 62/228.3; 236/1 EA; 417/62

[58] Field of Search ..... 62/228.3, 228.5, 62/196.1, 196.2, 196.3, 510, 117, 176.3; 236/1 EA; 417/62

[56] References Cited

U.S. PATENT DOCUMENTS

| | | | |
|---|---|---|---|
| 2,319,130 | 5/1943 | Hanson | 62/228.5 X |
| 3,098,449 | 7/1963 | Hill | 417/62 X |
| 4,494,383 | 1/1985 | Nagatomo et al. | 62/196.2 |
| 4,938,029 | 7/1990 | Shaw | 62/117 |
| 5,016,447 | 5/1991 | Lane et al. | 62/470 |
| 5,062,274 | 11/1991 | Shaw | 62/117 |
| 5,094,085 | 3/1992 | Irino | 62/196.2 X |

FOREIGN PATENT DOCUMENTS

| | | | |
|---|---|---|---|
| 53-133257 | 2/1978 | Japan . | |
| 3-267592 | 11/1991 | Japan | 417/62 |

*Primary Examiner*—Harry B. Tanner

[57] ABSTRACT

In a positive displacement compressor having a plurality of banks, operation can be multi-staged or single staged. Single stage operation can be of a single bank or plural banks in parallel. Switch-over between modes of operation is under the control of a microprocessor responsive to sensed inputs.

16 Claims, 4 Drawing Sheets

COMPRESSOR FOR SINGLE OR MULTI-STAGE OPERATION

BACKGROUND OF THE INVENTION

Transport refrigeration can have a load requiring a temperature of −20° F. in the case of ice cream, 0° F. in the case of some frozen foods and 40° F. in the case of flowers and fresh fruit and vegetables. A trailer may also have more than one compartment with loads having different temperature requirements. Additionally, the ambient temperatures encountered may range from −20° F., or below, to 110° F., or more. Because of the wide range of ambient temperatures that can be encountered on a single trip as well as the load temperature requirements, there can be a wide range in refrigeration capacity requirements. Commonly assigned U.S. Pat. Nos. 4,938,029, 4,986,084 and 5,062,274 disclose reduced capacity operation responsive to load requirements while U.S. Pat. No. 5,016,447 discloses a two-stage compressor with interstage cooling. In reciprocating refrigeration compressors having multiple stages of compression, the intermediate pressure gas can be routed through the crankcase sump. Utilizing this approach for low temperature applications works quite well to increase the efficiency, however, in medium and high temperature applications several complications arise. Higher crankcase pressures produce a lower effective oil viscosity, increased thrust washer loads, and increased bearing loads.

SUMMARY OF THE INVENTION

A compressor having plural banks of cylinders can be operated multi-stage during low temperature operation and with a single stage or plural parallel single stages for medium and high temperature operation. Switching between single stage and multi-stage operation is under the control of a microprocessor in response to the sensed interstage or crankcase sump pressure. Multi-stage operation provides increased capacity through the use of an economizer. Reduced capacity operation can be achieved by bypassing the first stage back to suction or by employing suction cutoff in the first stage.

It is an object of this invention to overcome the operating limitations of a multi-staged compressor with an intermediate pressure sump.

It is another object of this invention to operate in a multi-staged mode for low temperature conditions and operate in a single stage mode for medium and high temperature conditions with the control of operation governed by the sump/intermediate pressure.

It is a further object of this invention to provide a compressor which is operable multi-staged or single staged with single stage operation being a single stage or plural, parallel single stages. These objects, and others as will become apparent hereinafter, are accomplished by the present invention.

Basically, the interstage or crankcase sump pressure is sensed and, responsive thereto, the compressor is operated in either a multi-stage or single stage mode. Single stage operation may be as plural banks in parallel or by unloading the first stage in multi-stage operation.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
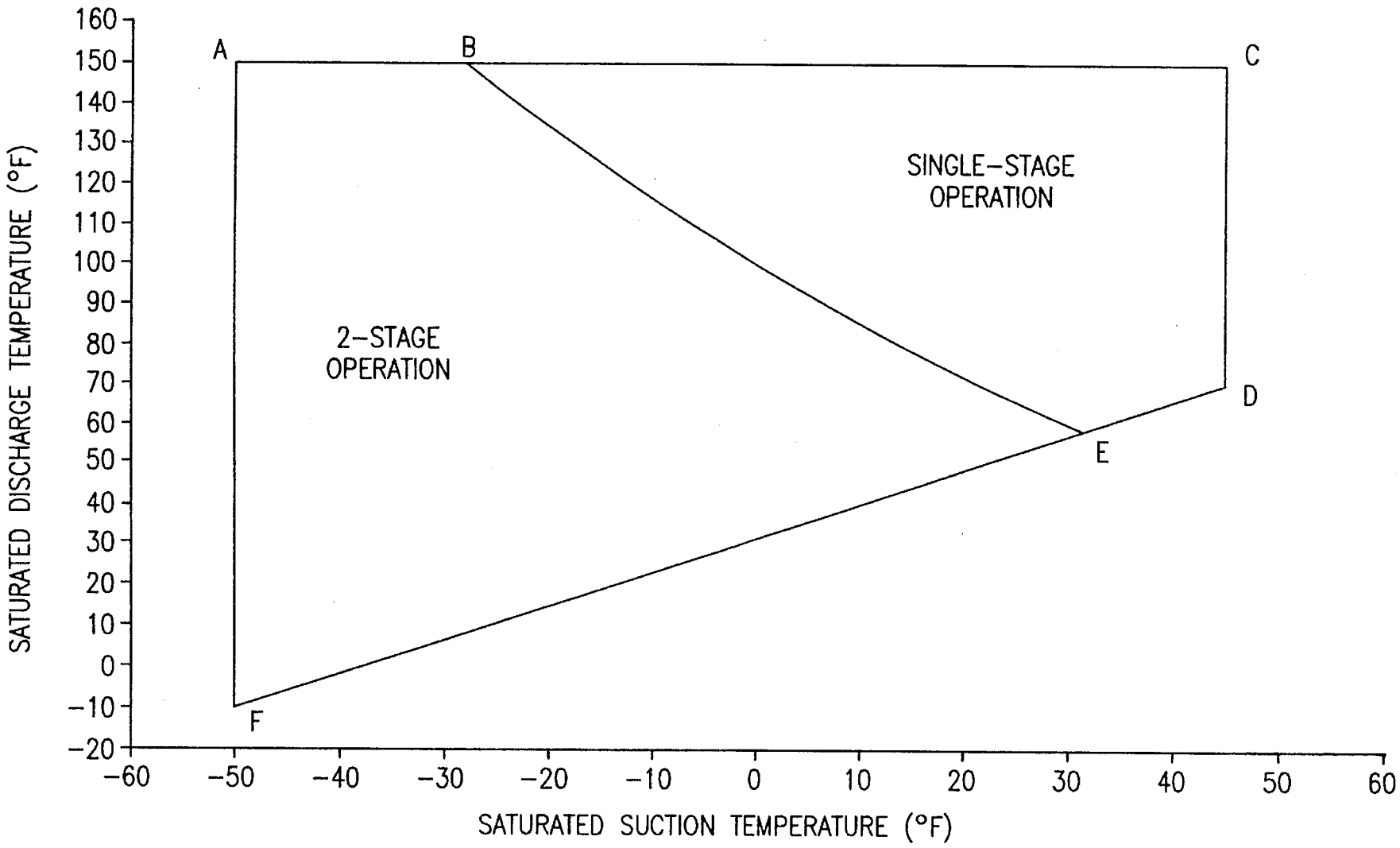
FIG. 1 is a graphical representation of a compound cooling operating envelope of a compressor operated in accordance with the teachings of the present invention.

In FIG. 1, A-B-C-D-E-F-A represents the operating envelope on a saturated discharge temperature vs. saturated suction temperature graph for a compressor employing R-22 in a compound cooling configuration. The line B-E represents the boundary between single stage and two-stage operation. The boundary is established based on sump or interstage pressure limited by thrust washer and bearing load as well as oil viscosity. Specifically, B-C-D-E-B represents the envelope where single stage operation is more effective and A-B-E-F-A represents the envelope where two-stage operation is more effective.

Figure 2:
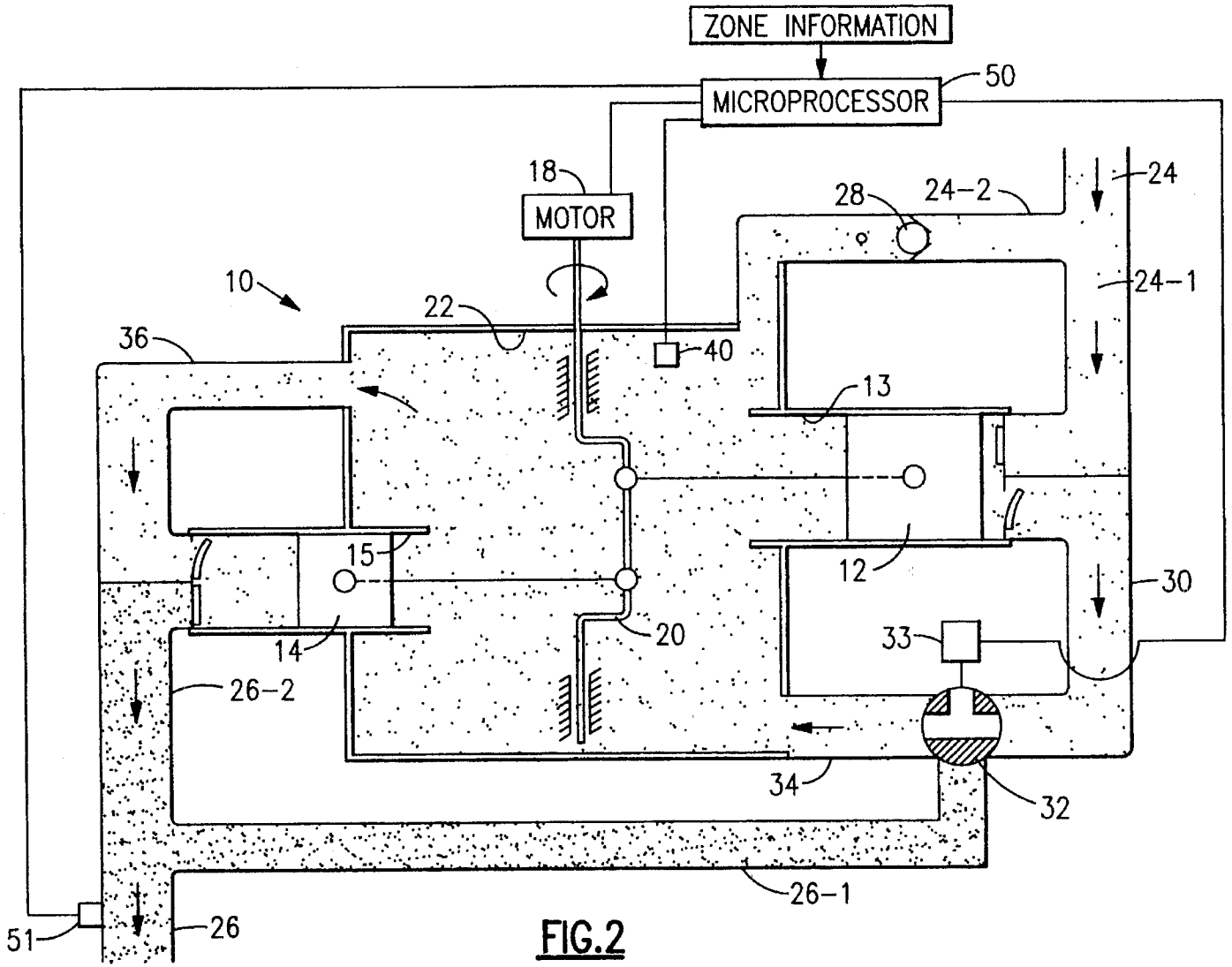
FIG. 2 is a schematic representation of a compressor in two-stage operation according to the teachings of the present convention.
Figure 3:
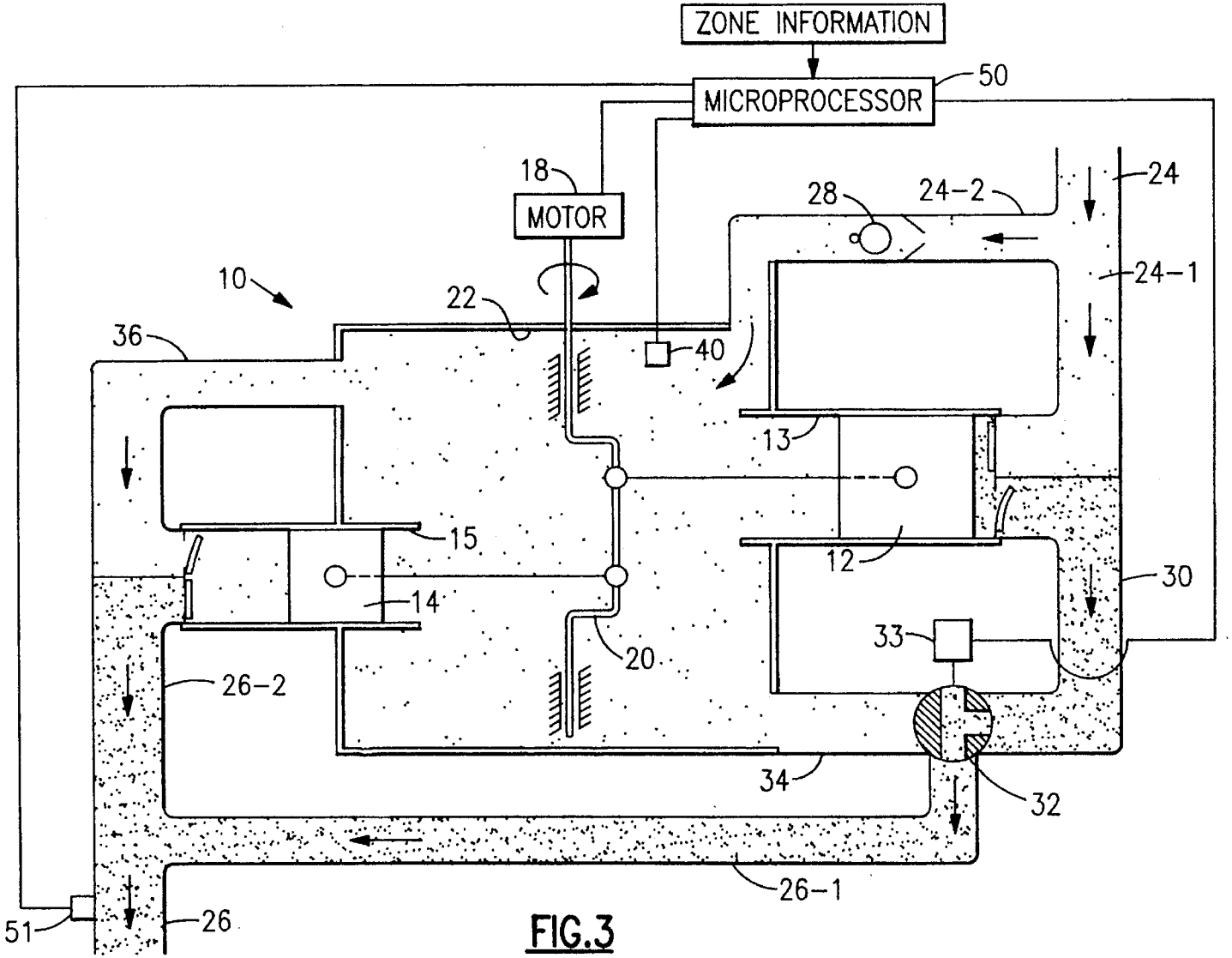
FIG. 3 is a schematic representation of a compressor in parallel single stage operation according to the teachings of the present invention.
Figure 4:
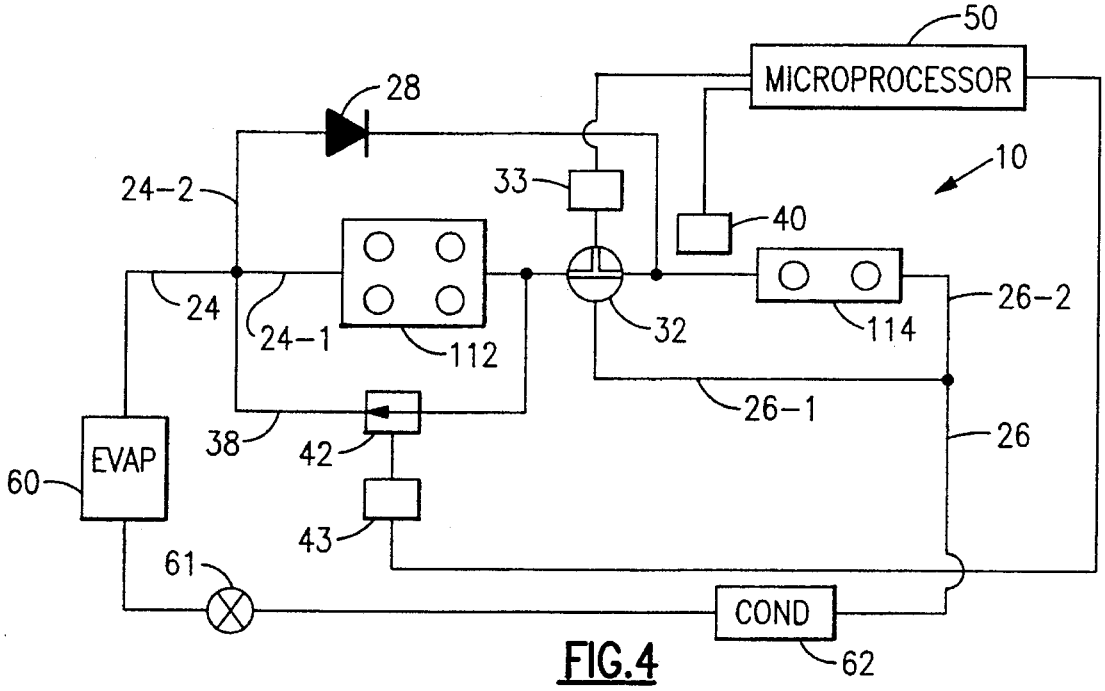
FIG. 4 is a schematic representation of a refrigeration system employing the compressor of the present invention employing first stage bypass.
Figure 5:
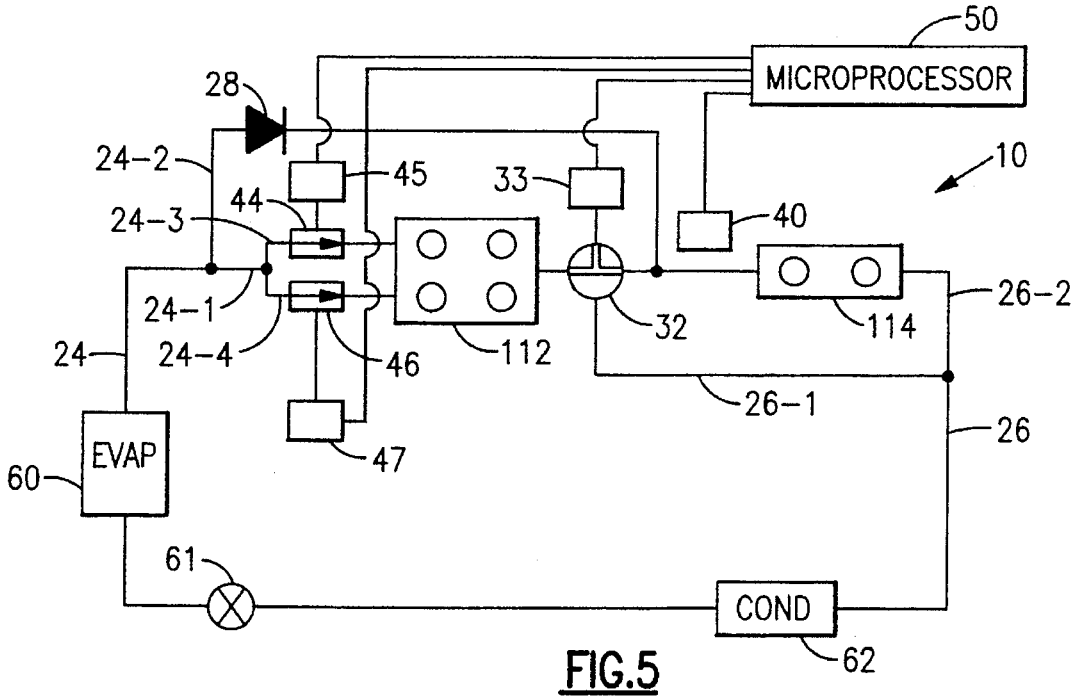
FIG. 5 is a schematic representation of a refrigeration system employing the compressor of the present invention employing suction cutoff.

In FIGS. 2 and 3 the numeral 10 generally designates a compressor having a plurality of banks with piston 12 and cylinder 13 representing a first bank of, typically, four cylinders and with piston 14 and cylinder 15 representing a second bank of, typically, two cylinders. Pistons 12 and 14 are reciprocatably driven by motor 18 through crankshaft 20. Crankshaft 20 is located in crankcase 22 which has an oil sump located at the bottom thereof. Compressor 10 has a suction inlet 24 and a discharge 26 which are connected, respectively, to the evaporator 60 and condenser 62 of a refrigeration system, as best shown in FIGS. 4 and 5. Expansion device 61 is located between evaporator 60 and condenser 62. Suction inlet 24 branches into line 24-1 which feeds the cylinders of the first bank represented by piston 12 and line 24-2 which contains check valve 28 and connects with crankcase 22. The first bank represented by piston 12 discharges hot, high pressure refrigerant gas into line 30 which contains 3-way valve 32. Depending upon the position of 3-way valve 32, the hot high pressure gas from line 30 is supplied either to discharge 26 via line 26-1 or to crankcase 22 via line 34. Gas from crankcase 22 is drawn via line 36 into the cylinders of the second bank represented by piston 14 where the gas is compressed and delivered to discharge line 26 via line 26-2.

Microprocessor 50 controls the position of 3-way valve 32 through operator 33 responsive to one or more sensed conditions. Pressure sensor 40 senses the pressure in crankcase 22 which is a primary indicator of the operation of compressor 10 since mid-stage pressure is equal to the square root of the product of the absolute suction and discharge pressures. Microprocessor 50 receives zone information representing the set point and temperature in the zone(s) being cooled as well as other information such as the inlet and outlet temperatures and/or pressures for compressor 10 as exemplified by sensor 51. Initial operation is responsive to the zone set point such that a low temperature setting initially results in a two-stage operation while a medium or high temperature setting initially results in a single stage operation. Microprocessor 50 controls 3-way valve 32 through operator 33 to produce two-stage or single stage operation. Referring to FIG. 2, two-stage operation results when 3-way valve 32 connects lines 30 and 34. Gas supplied to line 24 from the evaporator is supplied via line 24-1 to the first bank represented by piston 12 and the gas is compressed and supplied to line 30 and passes via 3-way valve 32 and line 34 into the crankcase 22. The gas in crankcase 22 is then drawn via line 36 into the second bank represented by piston 14 and the gas is further compressed and directed via lines 26-2 and 26 to the condenser. Flow of high stage discharge gas is prevented from entering crankcase 22 via line 26-1 by 3-way valve 32 and flow of suction gas into crankcase 22 via line 24-2 is prevented by the back pressure in crankcase 22 acting on check valve 28.

Referring now to FIG. 3, parallel single stage operation results when 3-way valve 32 connects lines 30 and 26-1. Gas supplied to line 24 from the evaporator is supplied via line 24-1 to the first bank represented by piston 12 and the gas is compressed and supplied to line 30 and passes via 3-way valve 32, line 26-1 and line 26 to the condenser. Gas in crankcase 22 is at suction pressure so that gas is able to flow from line 24, through line 24-2 and check valve 28 into crankcase 22. Gas from crankcase 22 is drawn via line 36 into the second bank represented by piston 14, compressed and discharged via line 26-2 into common discharge 26.

Once compressor 10 is in operation, the microprocessor 50 will cause 3-way valve 32 to switch between the two-stage operation of FIG. 2 and the parallel single stage operation of FIG. 3 essentially in accordance with the appropriate operating envelope, as exemplified in FIG. 1. Specifically, the pressure sensed by pressure sensor 40 is compared to a fixed value to determine whether two-stage or single stage operation is appropriate and 3-way valve 32 is appropriately positioned. The density of the stippling in FIGS. 2 and 3 is an indication of the pressure of the gas.

Capacity control can take place in the FIGS. 2 and 3 configurations by employing a variable speed motor 18. Additionally, as shown in FIG. 4, capacity control can be achieved by adding bypass line 38 containing solenoid valve 42. Microprocessor 50 controls power to coil 43 of solenoid valve 42 to thereby control solenoid valve 42. Specifically, when capacity control is needed, as sensed by microprocessor 50 through the zone information, coil 43 is powered causing solenoid valve to open permitting flow in bypass line 38. Thus, the discharge of first or low stage 112 can flow back to suction of first stage 112. This lowers the interstage pressure sensed by pressure sensor 40 to a value slightly higher than suction pressure and the entire load is carried by the second stage 114 only. This effectively makes compressor 10 a single stage compressor with the displacement of the second or high stage 114.

FIG. 5 illustrates the use of suction cutoff for capacity control. Suction line 24-1 divides into lines 24-3 and 24-4 which respectively feed the two banks of first or low stage 112. Line 24-3 contains solenoid valve 44 having coil 45 and line 24-4 contains solenoid valve 46 having coil 47. When capacity control is needed, as sensed by microprocessor 50 through the zone information, coil 45 and/or coil 47 is actuated by microprocessor 50 causing valve 44 and/or valve 46 to close. This approach allows greater capacity control than the configuration of FIG. 4 because a six cylinder compressor, for example, can operate the with just the two cylinders of second or high stage 114 loaded (valves 44 and 46 closed), four cylinders loaded (either valve 44 or 46 open), or all six cylinders loaded (valves 44 and 46 open). When this approach is used with a two-stage compressor, it allows for operation in a two-stage mode (FIG. 2), single stage with all six cylinders (FIG. 3), or single stage with one third loading increments as described above.

From the foregoing description it should be clear that the present invention provides a very wide range of compressor operation that can be achieved under the control of microprocessor 50. This wide range of compressor operation permits particularly effective operation in transport refrigeration where there is a wide range of load temperature requirements and ambient temperatures.

Although preferred embodiments of the present invention have been illustrated and described, other modifications will occur to those skilled in the art. It is therefore intended that the present invention is to be limited only by the scope of the appended claims.

What is claimed is:

1. Compressor means having a crankcase, a suction inlet adapted to be connected to an evaporator and a discharge adapted to be connected to a condenser comprising:

a plurality of banks;

at least one bank of said plurality of banks normally connected to said suction inlet;

another bank of said plurality of banks normally connected to said crankcase and said discharge;

means for selectively connecting said at least one bank to either said crankcase or said discharge;

means for fluidly connecting said crankcase to said suction inlet when said at least one bank is connected to said discharge;

whereby when said at least one bank is connected to said crankcase, said another bank acts as a second stage and when said at least one bank is connected to said discharge said at least one bank and said another bank act as parallel single stage compressors.

2. The compressor means of claim 1 further including means for controlling capacity of said at least one bank.

3. The compressor means of claim 2 wherein said means for controlling capacity includes means for selectively bypassing said at least one bank.

4. The compressor means of claim 2 wherein said means for controlling capacity includes means for selectively controlling flow from said suction inlet to said at least one bank.

5. Compressor means having a crankcase, a suction inlet adapted to be connected to an evaporator and a discharge adapted to be connected to a condenser comprising:

three banks;

a first and a second one of said three banks being normally connected to said suction inlet;

a third one of said plurality of banks being normally connected to said crankcase and said discharge;

means for selectively connecting said first and second banks to either said crankcase or said discharge;

means for fluidly connecting said crankcase to said suction inlet when said first and second banks are connected to discharge;

whereby when said first and second banks are connected to said crankcase they act as a first stage and said third bank acts as a second stage and when said first and second banks are connected to discharge they act as a single stage and said third bank acts as a single stage in parallel with said first and second banks.

6. The compressor means of claim 5 further including means for controlling capacity of said first and second banks.

7. The compressor means of claim 6 wherein said means for controlling capacity includes means for selectively bypassing said first and second bank.

8. The compressor means of claim 6 wherein said means for controlling capacity includes means for selectively controlling flow from said suction inlet to said first and second banks.

9. Refrigeration means for cooling a zone including a closed circuit serially including compressor means, condenser means, expansion means and evaporator means:

said compressor having three banks, a crankcase, a suction inlet connected to said evaporator and a discharge connected to said condenser;

a first and a second one of said three banks being normally connected to said suction inlet;

a third one of said three banks being normally connected to said crankcase and said discharge;

means for selectively connecting said first and second banks to either said crankcase or said discharge;

means for fluidly connecting said crankcase to said suction inlet when said first and second banks are connected to discharge;

whereby when said first and second banks are connected to said crankcase they act as a first stage and said third bank acts as a second stage and when said first and second banks are connected to discharge they act as a single stage and said third bank acts as a single stage in parallel with said first and second banks.

10. The compressor means of claim 9 further including means for controlling capacity of said first and second banks.

11. The compressor means of claim 10 wherein said means for controlling capacity includes means for selectively bypassing said first and second bank.

12. The compressor means of claim 10 wherein said means for controlling capacity includes means for selectively controlling flow from said suction inlet to said first and second banks.

13. The compressor of claim 9 further including means for sensing pressure in said crankcase and said means for selectively connecting is responsive to sensed pressure in said crankcase.

14. A method for operating a compressor having three banks, a crankcase, a suction inlet adapted to be connected to an evaporator and a discharge adapted to be connected to a condenser comprising the steps of:

supplying gas from said suction inlet to a first and second bank of said three banks;

supplying gas from said crankcase to a third bank of said three banks;

delivering compressed gas from said third bank to said discharge;

selectively connecting said first and second banks to either said crankcase or said discharge whereby when said first and second banks are connected to said crankcase they act as a first stage and said third bank acts as a second stage and when said first and second banks are connected to discharge they act as a single stage and said third bank acts as a single stage in parallel with said first and second banks.

15. The method of claim 14 further including the step of controlling capacity of said first and second bank.

16. The method of claim 14 further including the step of sensing pressure in said crankcase; and using the sensed pressure for controlling said step of selectively connecting said first and second banks to said crankcase or discharge.

* * * * *